US008157352B2

(12) United States Patent
Von Essen et al.

(10) Patent No.: US 8,157,352 B2
(45) Date of Patent: Apr. 17, 2012

(54) FLUID EJECTING WITH CENTRALLY FORMED INLETS AND OUTLETS

(75) Inventors: Kevin Von Essen, San Jose, CA (US); Andreas Bibl, Los Altos, CA (US)

(73) Assignee: FUJIFILM Corporation, Tokyo (JP)

( * ) Notice: Subject to any disclaimer, the term of this patent is extended or adjusted under 35 U.S.C. 154(b) by 405 days.

(21) Appl. No.: 12/393,985

(22) Filed: Feb. 26, 2009

(65) Prior Publication Data

US 2010/0214359 A1 Aug. 26, 2010

(51) Int. Cl.
*B41J 2/155* (2006.01)

(52) U.S. Cl. ..... 347/42

(58) Field of Classification Search ..... 347/20, 347/40–42, 45, 47
See application file for complete search history.

(56) References Cited

U.S. PATENT DOCUMENTS

| | | | | |
|---|---|---|---|---|
| 6,718,632 | B2 * | 4/2004 | Liu et al. | 29/890.1 |
| 6,826,966 | B1 | 12/2004 | Karbassi et al. | |
| 7,121,650 | B2 * | 10/2006 | Chung et al. | 347/68 |
| 2007/0188564 | A1 | 8/2007 | Harvey et al. | |

FOREIGN PATENT DOCUMENTS

| | | |
|---|---|---|
| WO | 2009/143025 | 11/2009 |
| WO | 2009/143362 | 11/2009 |

* cited by examiner

*Primary Examiner* — An Do
(74) *Attorney, Agent, or Firm* — Fish & Richardson P.C.

(57) ABSTRACT

An apparatus for ejecting droplets of a fluid includes a substrate, a first plurality of nozzles formed in a first region of a nozzle face of the substrate, and a second plurality of nozzles formed in a second region of the nozzle face. The second region is separated from the first region. An inlet and an outlet are both formed in an upper face of the substrate opposite a third region of the nozzle face, the third region being located between the first region and the second region, and a plurality of fluid paths formed in the substrate and fluidically connecting the first plurality of nozzles and the second plurality of nozzles with the inlet and outlet.

22 Claims, 12 Drawing Sheets

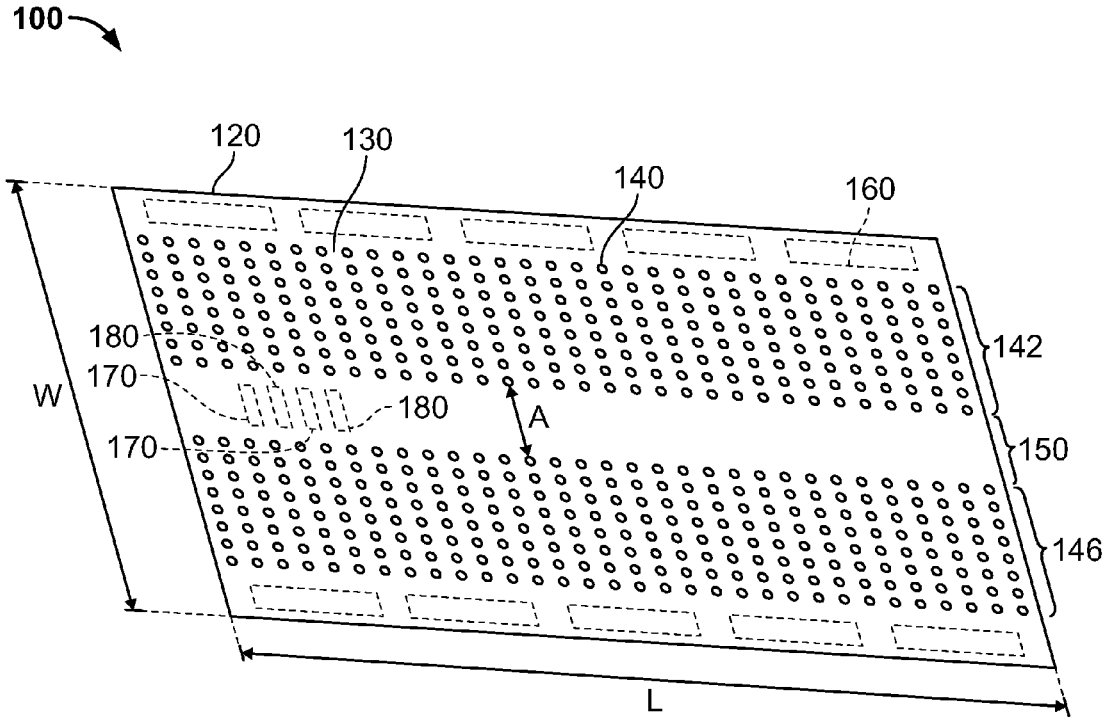
FIG. 1
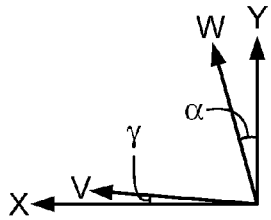

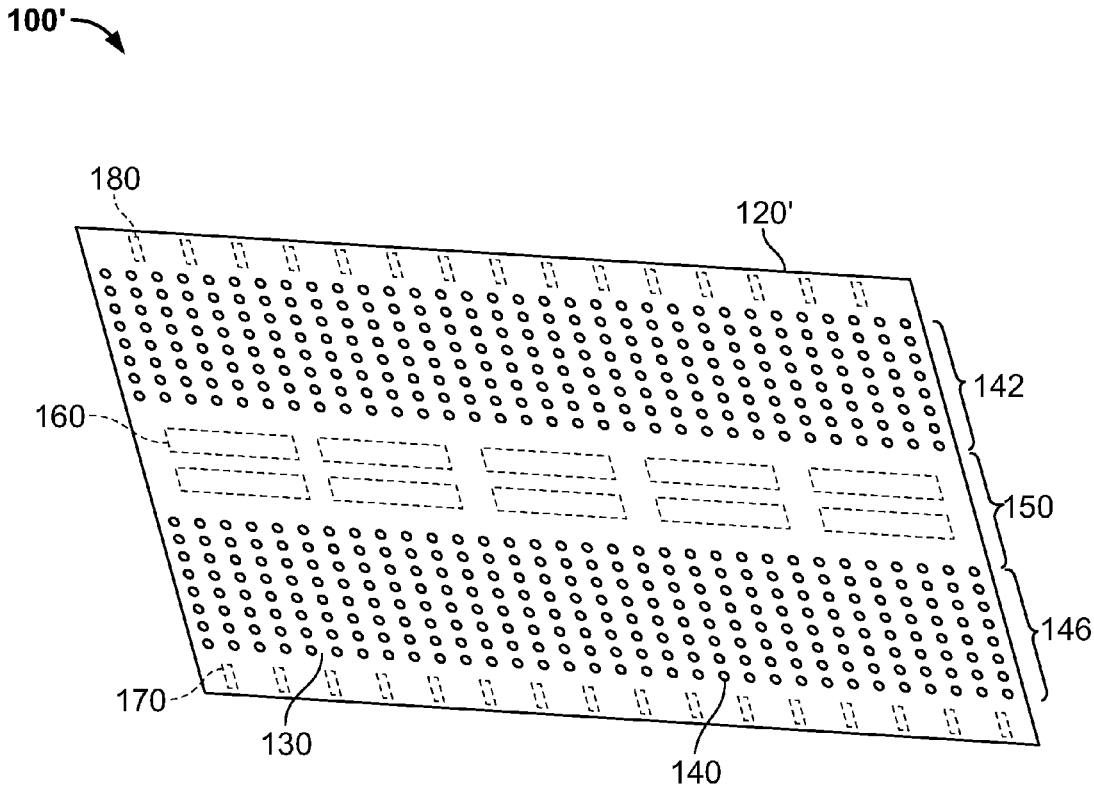
FIG. 7
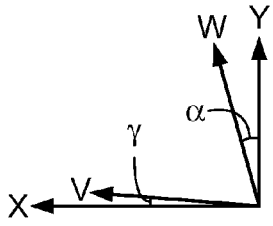

FLUID EJECTING WITH CENTRALLY FORMED INLETS AND OUTLETS

BACKGROUND

This description relates to fluid droplet ejection. In some fluid ejection devices, a substrate includes a fluid pumping chamber, a descender, and a nozzle. Fluid droplets can be ejected from the nozzle onto a medium, such as in a printing operation. The nozzle is fluidly connected to the descender, which is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The transducer can be actuated by a voltage applied by a trace that electrically connects the transducer to a voltage source, such as an application-specific integrated circuit (ASIC). The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

In one aspect, an apparatus for ejecting droplets of a fluid includes a substrate, a first plurality of nozzles formed in a first region of a nozzle face of the substrate, a second plurality of nozzles formed in a second region of the nozzle face, the second region being separated from the first region, an inlet and an outlet both formed in an upper face of the substrate opposite a third region of the nozzle face, the third region being located between the first region and the second region, and a plurality of fluid paths formed in the substrate and fluidically connecting the first plurality of nozzles and the second plurality of nozzles with the inlet and outlet.

In another aspect, a method for ejecting fluid droplets includes flowing a flow of fluid to a substrate, the substrate including a first plurality of nozzles formed in a first region of a nozzle face of the substrate and a second plurality of nozzles formed in a second region of the nozzle face, the second region being separated from the first region, flowing the flow of fluid through an inlet formed in an upper face of a substrate opposite a third region of the nozzle face, the third region being located between the first region and the second region and the inlet being fluidically connected to a fluid path formed in the substrate, flowing the flow of fluid through the fluid path, the fluid path being fluidically connected to a nozzle of the first plurality of nozzles and a nozzle of the second plurality of nozzles, and flowing the flow of fluid from the fluid path through an outlet formed in the upper face opposite the third region, the outlet being fluidically connected to the fluid path.

Implementations may include one or more of the following. A plurality of inlets and outlets may be formed adjacent to one another in an alternating pattern. An application-specific integrated circuit may be attached to the upper face near an edge of the substrate. An interposer may be attached to the upper face of the substrate. The interposer may include an inlet passage formed in an interposer face of the interposer and configured to align with the inlet of the substrate, and an outlet passage formed in the interposer face and configured to align with the outlet of the substrate. The substrate may have a length along a length direction and a width along a width direction, with the width being shorter than the length, and the inlet and the outlet may be positioned, along the width direction, between the first region and the second region. A support may be configured to position a medium proximate the nozzle face and move the medium in a medium travel direction relative to the nozzle face. A first group of nozzles may be formed in the nozzle face, positioned on a first column, and configured to eject a first set of fluid droplets onto the medium. A second group of nozzles may be formed in the nozzle face, positioned on a second column that is different than the first column and separated from the first column, and configured to deposit a second set of fluid droplets onto the medium as the medium moves in the medium travel direction, the second set of fluid droplets being adjacent the first set of fluid droplets. The first column and the second column may be parallel to one another.

A first fluid inlet channel may be positioned substantially parallel to the first column and fluidically connected to the first group of nozzles. A second fluid inlet channel, different than the first fluid inlet channel, may be positioned substantially parallel to the second column and fluidically connected to the second group of nozzles. A third group of nozzles may be formed in the nozzle face and positioned on a third column that is different than the first and second columns but is substantially parallel with a column direction of the first column. The first group of nozzles may be in the first region, the second group nozzles may be in the second region, and the third group of nozzles may be in the second region. The third group of nozzles may be fluidically connected to the first fluid inlet channel. The first fluid inlet channel may be substantially linear.

In another aspect, an apparatus for ejecting droplets of a fluid includes a substrate, a first plurality of nozzles formed in a first region of a nozzle face of the substrate, a second plurality of nozzles formed in a second region of the nozzle face, the second region being separated from the first region, and an application-specific integrated circuit attached to an upper face of the substrate opposite a third region of the nozzle face, the third region being located between the first region and the second region.

DESCRIPTION OF DRAWINGS

FIG. 1 is a plan-view schematic representation of a substrate.

FIG. 7 is a plan-view schematic representation of an alternative implementation of a substrate.

Like reference symbols in the various drawings indicate like elements.

DETAILED DESCRIPTION

A fluid ejection printhead module can be constructed with fluid inlets/outlets located near the middle of the printhead die, ASICs secured near the edge of the printhead die, and piezoelectric actuators for individually controllable nozzles between the inlets/outlets and the ASICs.

Fluid droplet ejection can be implemented with a printhead module which is a die fabricated using semiconductor processing techniques. The printhead module includes a substrate, such as a silicon substrate, in which a plurality of microfabricated fluid flow paths are formed, and a plurality of actuators to cause fluid to be selectively ejected from nozzles of the flow paths. Thus, each flow path with its associated actuator provides an individually controllable MEMS fluid ejector unit.

Fluid can be ejected onto a medium, and the printhead and the medium can undergo relative motion during fluid droplet ejection. The fluid can be, for example, a chemical compound, a biological substance, or ink. The fluid can be continuously circulated through the flow path and fluid that is not ejected out of the nozzle can be directed through a recirculation passage. The substrate can include multiple fluid flow paths and multiple nozzles.

An apparatus for fluid droplet ejection can be implemented with two nozzle areas on a nozzle face of the substrate, the two nozzle areas being separated by a gap region. The gap region can be along a middle of a substrate. Fluid inlets and outlets can be formed in the substrate opposite the gap region, that is, on an upper face that is on a side of the substrate opposite the gap region. Nozzles in the nozzle areas can be in fluid communication with fluid pumping chambers, which can be actuated by transducers. A transducer can be actuated by a voltage applied across the transducer, and the voltage can be applied by a trace. Traces can electrically connect the transducer to application-specific integrated circuit (ASIC) chips. It can be desirable to maximize a width of traces that electrically connect ASIC chips to transducers. The ASIC chips (ASICs) can be attached to the substrate near edges of the substrate. Positioning the inlets and outlets near the middle of the substrate can increase a surface area of the upper face of the substrate that is available for the traces as compared to, for example, positioning the inlets and outlets between the ASICs and the transducers. Positioning the inlets and outlets away from the traces can also facilitate implementing relatively larger bond areas. This can be desirable to improve bonding to the substrate and reduce a likelihood of fluid leaks, which might degrade performance of the printhead, such as by electrical shorting of traces through the fluid.

Figure 2A:
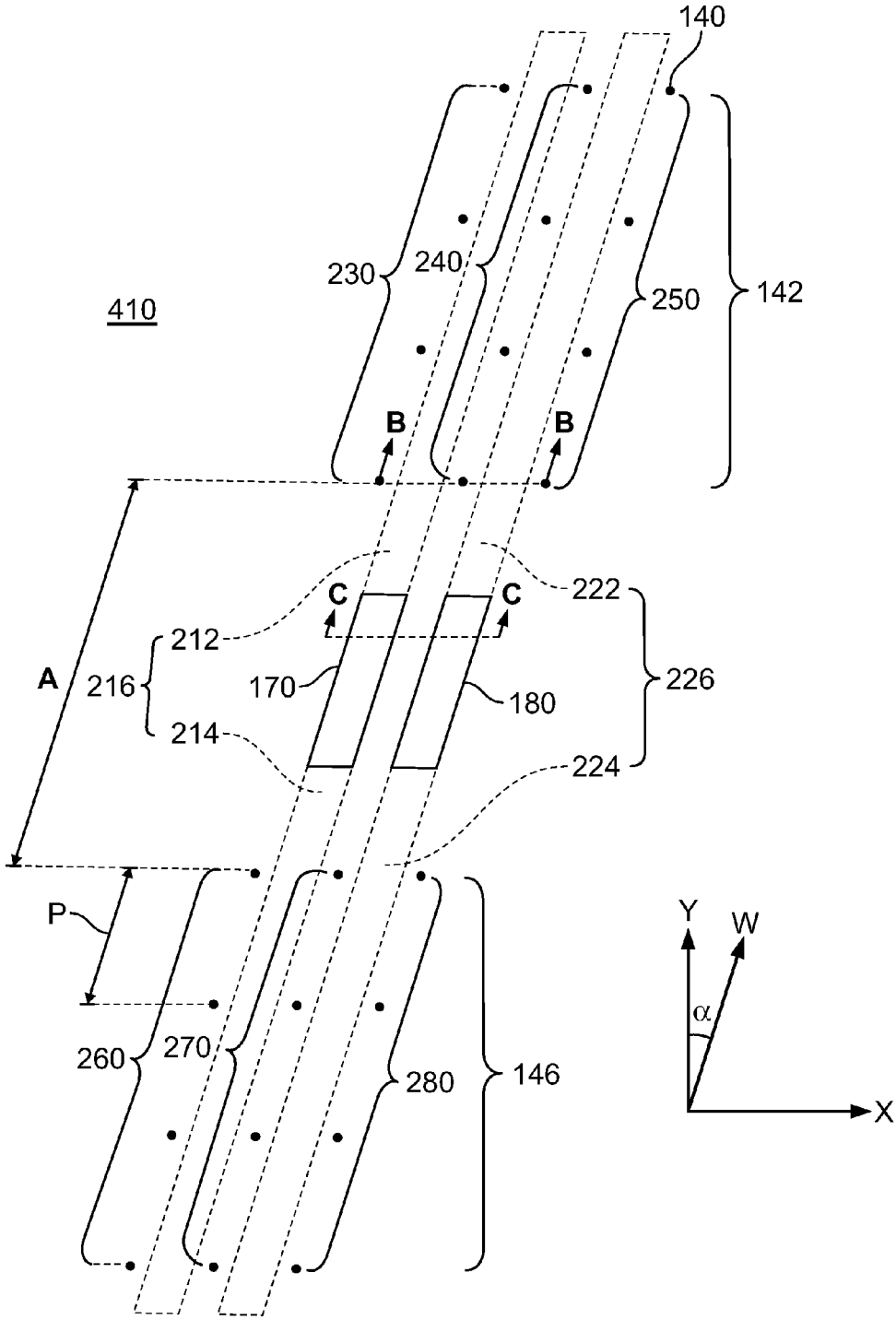
FIG. 2A is a plan-view schematic representation of a portion of substrate.
Figure 2B:
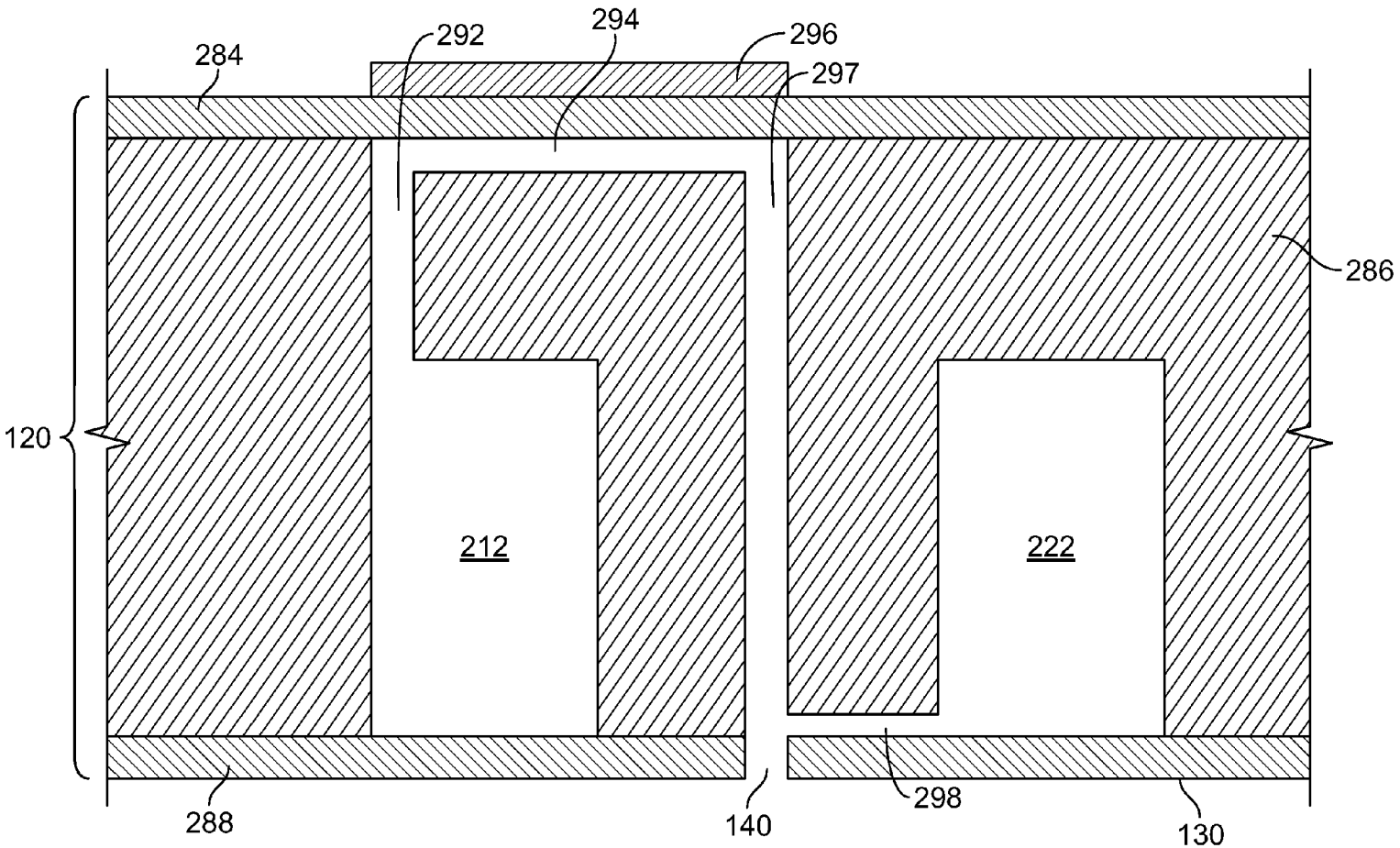
FIG. 2B is an elevation-view cross-sectional schematic representation taken along line B-B in FIG. 2A.
Figure 2C:
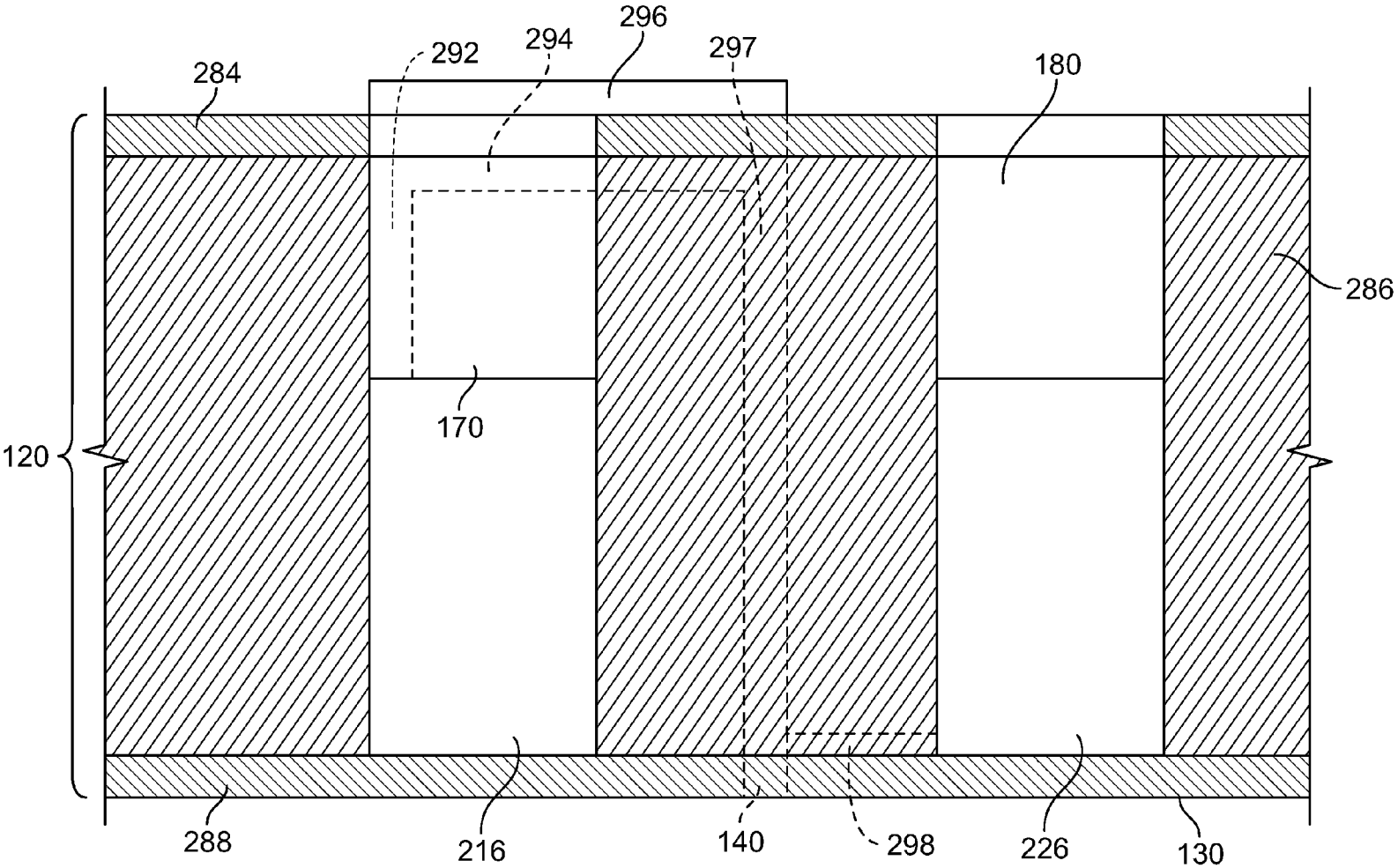
FIG. 2C is an elevation-view cross-sectional schematic representation taken along line C-C in FIG. 2A.

FIG. 1 is a plan-view schematic representation of an implementation of a printhead module 100 that includes a substrate 120 and a plurality of transducers 296 (see FIGS. 2B and 2C). In some implementations, the substrate 120 is formed in a parallelogram shape with a length L in a v direction (parallel to one edge of the substrate) and a width W in a w direction (parallel to the other edge of the substrate) that is less than the length L. The substrate 120 can be composed of, for example, silicon, and the substrate 120 can be constructed using conventional semiconductor fabrication techniques.

The substrate 120 can have a nozzle face 130 that can include a plurality of nozzles 140. In some implementations, each nozzle 140 is fluidically connected to a fluid pumping chamber 294 (see FIGS. 2B and 2C) that has a corresponding transducer 296. When the transducer 296 is actuated, the pumping chamber 294 contracts so that a fluid droplet is ejected from the corresponding nozzle 140.

The nozzles 140 can be arranged in a first nozzle region 142 and a second nozzle region 146, which can be separated from one another by a gap region 150. As an example, the first and second nozzle regions 142, 146 can each include 64 column portions each including 16 nozzles 140, and the nozzle face 130 can thereby include 2048 nozzles 140. The first nozzle region 142 and second nozzle region 146 can be parallelograms, e.g., with edges parallel to the v and w directions. The first and second nozzle regions 142, 146 can have the same internal angles, e.g., can be congruent. The gap region 150 can have a generally uniform width of gap distance A along the w direction. The gap distance A can be a distance of separation between the first nozzle region 142 and the second nozzle region 146. For example, the gap distance A can be about one fifth the width W of the substrate. For example, the gap distance A can be about two to eight millimeters.

ASICs 160 can be attached to the substrate 120 near edges of the substrate 120, such as near edges of the substrate 120 parallel to the v direction. The ASICs 160 can be attached to the substrate 120 on an upper face 410 (see FIG. 4) of the substrate 120 that is opposite the nozzle face 130 (the ASICs 160 are accordingly illustrated in phantom in FIG. 1). Inlets 170 and outlets 180 can be formed in the substrate 120, such as in the upper face 410 of the substrate 120. The inlets 170 can be configured to supply fluid to the nozzles 140, as discussed further below.

Figure 8:
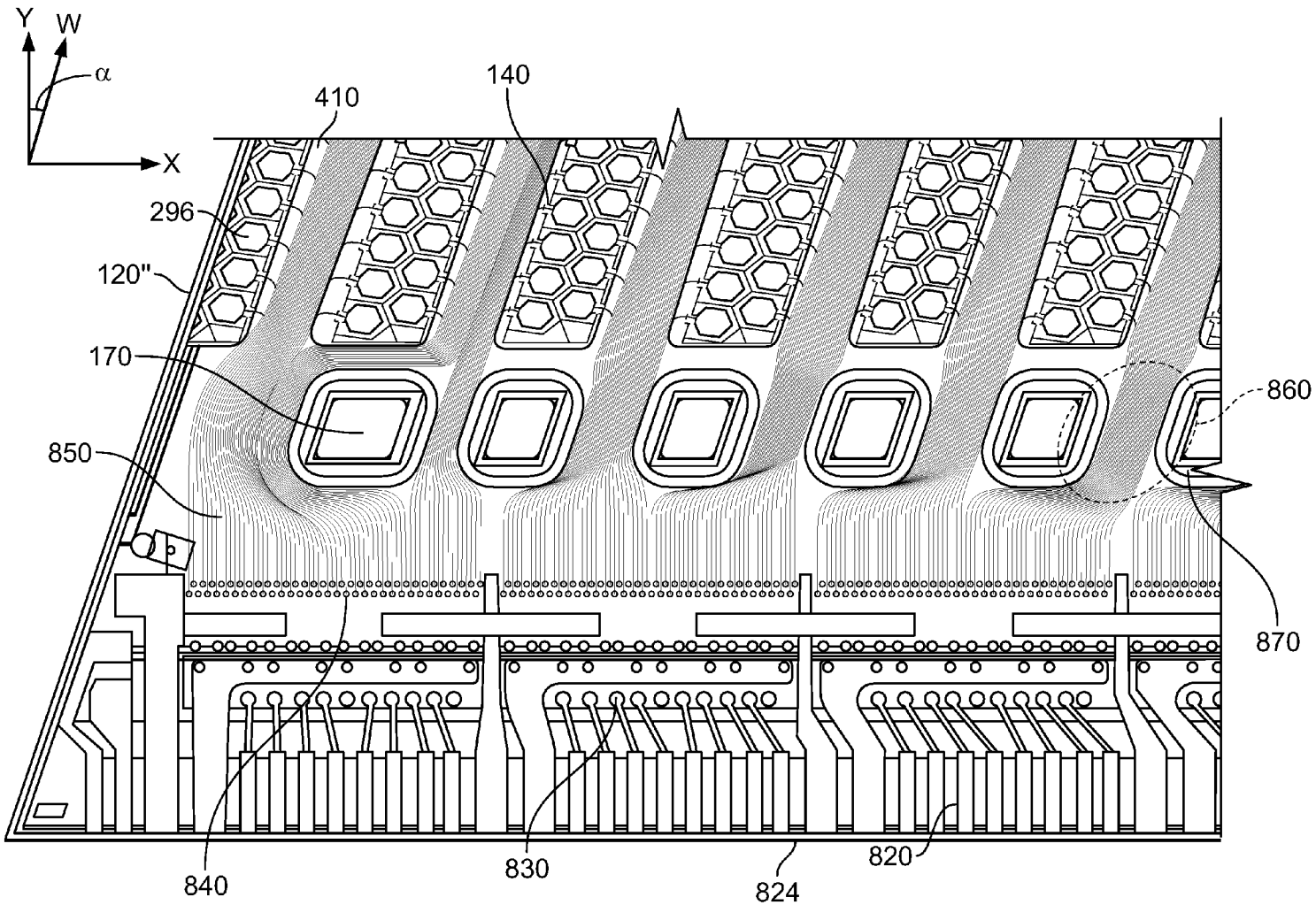
FIG. 8 is a plan-view schematic representation of a portion of a substrate.

For example, FIG. 8 is a plan-view schematic representation of a portion of the upper face 410 of an alternative implementation of the substrate 120". Input traces 820 of the substrate 120" can be positioned near an edge 824 of the substrate 120". Input trace ends 830 can be configured to electrically connect the input traces 820 to the ASICs 160. Trace ends 840 of the traces 850 can be configured to electrically connect the traces 850 to the ASICs 160. The traces 850 can thereby electrically connect the transducers 296 to the ASICs 160. In the implementation shown in FIG. 8, inlets 170 are formed in the upper face 410 between the ASICs 160 and the nozzles 140. The traces 850 can be compressed as necessary to fit on the upper surface 410 between or around the inlets 170, such as in trace region 860 (illustrated in phantom in FIG. 8). For example, a width of traces 850 in FIG. 8 can be about 6.0 microns, and a spacing between the traces 850 can be about 6.0 microns.

In FIG. 8, width of the traces 850 is reduced and spacing between traces 850 is reduced to accommodate positioning of the inlets 170 between the ASICs 160 and the transducers 296. It may be desirable to maximize a width of the traces 850 to minimize a risk of faulty connection by the traces 850, such as open circuits. Similarly, it may be desirable to maximize spacing between traces 850 to minimize a risk of electrical shorts between traces 850, as well as to minimize interference between traces 850, such as "cross-talk" or signal interference in which a voltage applied by one trace 850 may affect a voltage applied by another trace 850.

Further referring to FIG. 8, bond areas 870 around the inlets 170 may be minimized in the implementation shown in FIG. 8 to maximize surface area available for the traces 850. The bond areas 870 can be configured for attaching the substrate 120" to another component, such as an interposer 600 (see FIGS. 6A and 6B). The substrate 120" can be attached with, for example, an adhesive. Minimizing sizes of the bond areas 870 may increase a likelihood of fluid leakage from the inlets 170. It may therefore be desirable to maximize the sizes of the bond areas 870. Forming the inlets 170 and the outlets 180 in a portion of the substrate 120" that is not between the ASICs 160 and the transducers 296 (see FIG. 5) may therefore be desirable.

Figure 9:
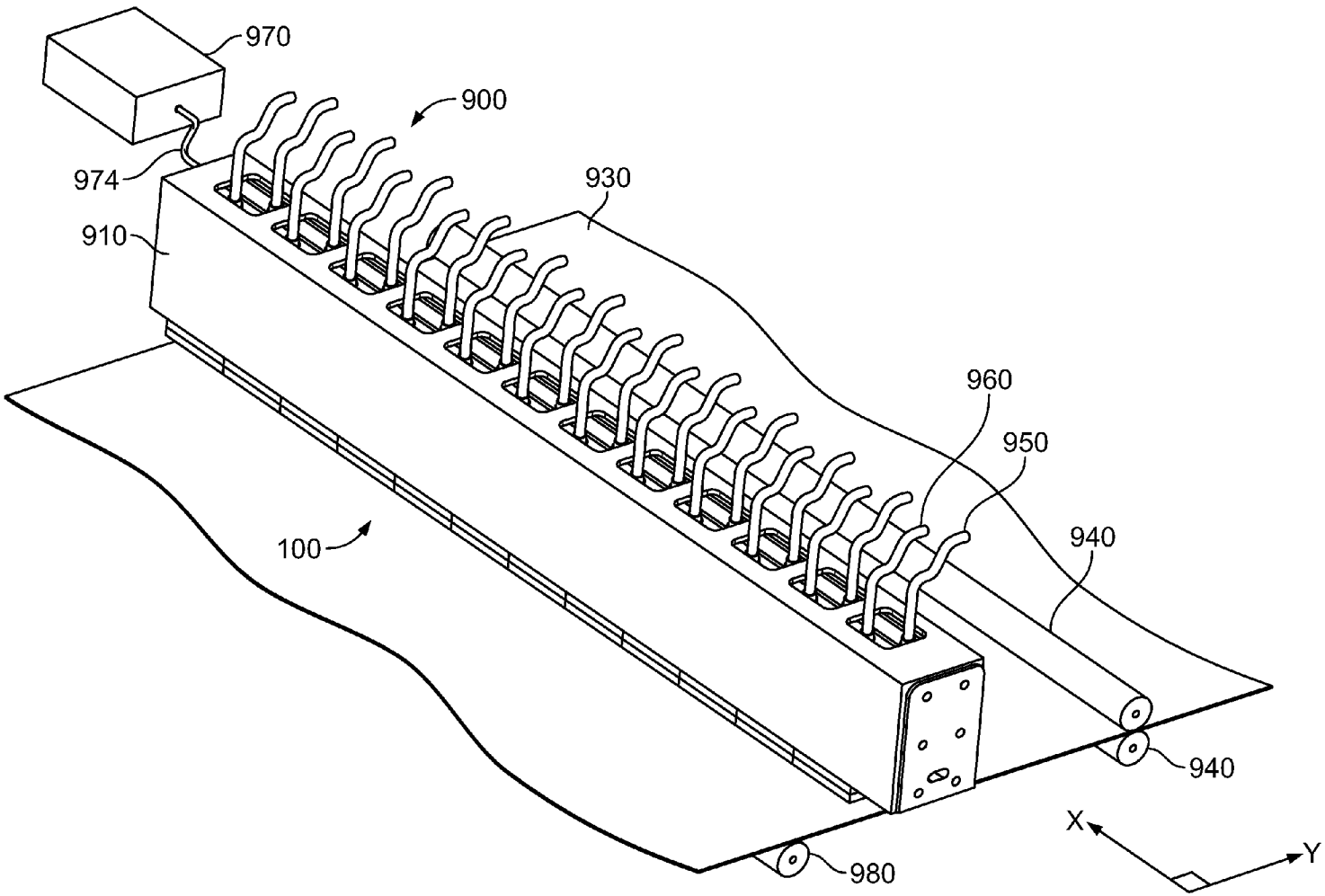
FIG. 9 is a perspective-view schematic representation of a print frame assembly.

FIG. 9 is a perspective-view schematic representation of a print frame assembly 900 that includes a print frame 910. The print frame 910 can support multiple printheads 100, which can be configured to deposit fluid droplets on a medium 930. The medium 930 can be moved, such as translated, by rollers 940. A medium travel direction can be the y direction, and an x direction can be perpendicular to the y direction and parallel to a surface of the medium. The medium can be supported by a medium support 980, which can include, for example, additional rollers 940, a conveyor belt, a surface, or some other suitable support. Fluid can be supplied to the printheads 100 by fluid supply hoses 950, which can in turn be supplied with fluid by a fluid supply (not shown), such as a tank containing fluid. Fluid can flow through the printheads 100 and through the substrates 120, as discussed further below, and fluid return hoses 960 can be configured to carry fluid away, such as for recirculation or disposal. A controller 970 can be in signal communication with the print frame assembly 900, such as through wiring 974, and can be configured to control ejection of fluid droplets from the nozzles 140 of the substrates 120. In some implementations, the controller 970 can also be configured to control movement of the medium 930, such as by being in signal communication with the rollers 940. The controller 970 can be, for example, a computer or a microprocessor.

In some implementations, the input traces 820 can be in signal communication with the controller 970. For example, the input traces 820 can be electrically connected to the controller 970 by a flex connector (not shown) and wiring 974. The ASICs 160 can be configured to use signals from the controller 970 to effect fluid droplet ejection from the nozzles 140 onto the medium 930.

FIG. 2A is a plan-view schematic representation of a portion 200 of the upper face 410 (see FIG. 4) of the substrate 120. For illustrative purposes, only a small number of nozzles 140 are shown (and as noted above, the nozzles 140 can be on the opposite surface of the die as the inlet 170 and outlet 180). The inlet 170 can be fluidically connected to an inlet channel 216. The inlet channel 216 can include first and second inlet channel portions 212, 214, which can extend in opposite directions from the inlet 170. The outlet 180 can be fluidically connected to outlet channel 226. The outlet channel 226 can include first and second outlet channel portions 222, 224, which can extend in opposite directions from the outlet 180. Each inlet channel 216 and outlet channel 226 is a passage inside the substrate extending parallel to the nozzle face 130 and upper face 410 (and thus are illustrated in phantom in FIG. 2A). In some implementations, the inlet 170 and the outlet 180 can be centrally located along the inlet channel 216 and the outlet channel 226, respectively. The inlet channel 216 and the outlet channel 226 can be arranged in parallel, e.g., along the w direction. Nozzles groups 230, 240, and 250 can be positioned in the first nozzle region 142. Nozzle groups 260, 270, and 280 can be positioned in the second nozzle region 146.

FIGS. 2B and 2C are elevation-view cross-sectional schematic representations taken along lines B-B and C-C, respectively, in FIG. 2A and in a direction of the arrows. The substrate 120 can include a membrane layer 284, a flow path body 286, and a nozzle layer 288. Referring to FIG. 2B, the first inlet channel portion 212 and the first outlet channel portion 222 are shown. Referring to FIG. 2C, the inlet 170 and the outlet 180 are shown. Referring to FIGS. 2A and 2B, an ascender 292 fluidically connects the inlet channel portion 212 with a fluid pumping chamber 294. Boundaries of the fluid pumping chamber 294 can be defined by the membrane layer 284 and the flow path body 286. A transducer 296 can be attached to a side of the membrane layer 284 opposite the fluid pumping chamber 294. The membrane layer 284 can be sufficiently deformable such that the transducer 296 can deflect the membrane layer 284 into the fluid pumping chamber 294. A descender 297 fluidically connects the fluid pumping chamber 294 with the nozzle 140 and a recirculation passage 298. The recirculation passage 298 fluidically connects the descender 297 with the outlet channel portion 222. Actuation of the transducer 296 can generate pressure in the fluid pumping chamber 294 sufficient to cause ejection of a fluid droplet through the nozzle 140.

Referring to FIGS. 2A-2C, nozzle groups 230, 240, 260, and 270 can be fluidically connected to the fluid inlet channel 216 through ascenders 292 and fluid pumping chambers 294. Nozzle groups 240, 250, 270, and 280 can be fluidically connected to the outlet channel 226 through recirculation passages 298. Nozzles 140 within the various nozzle groups can be separated by a nozzle pitch P, which is shown measured in the w direction in FIG. 2. Alternatively, the nozzle pitch P can be measured in the y direction. In some implementations, the nozzle pitch P can be uniform among the various nozzle groups.

Figure 3:
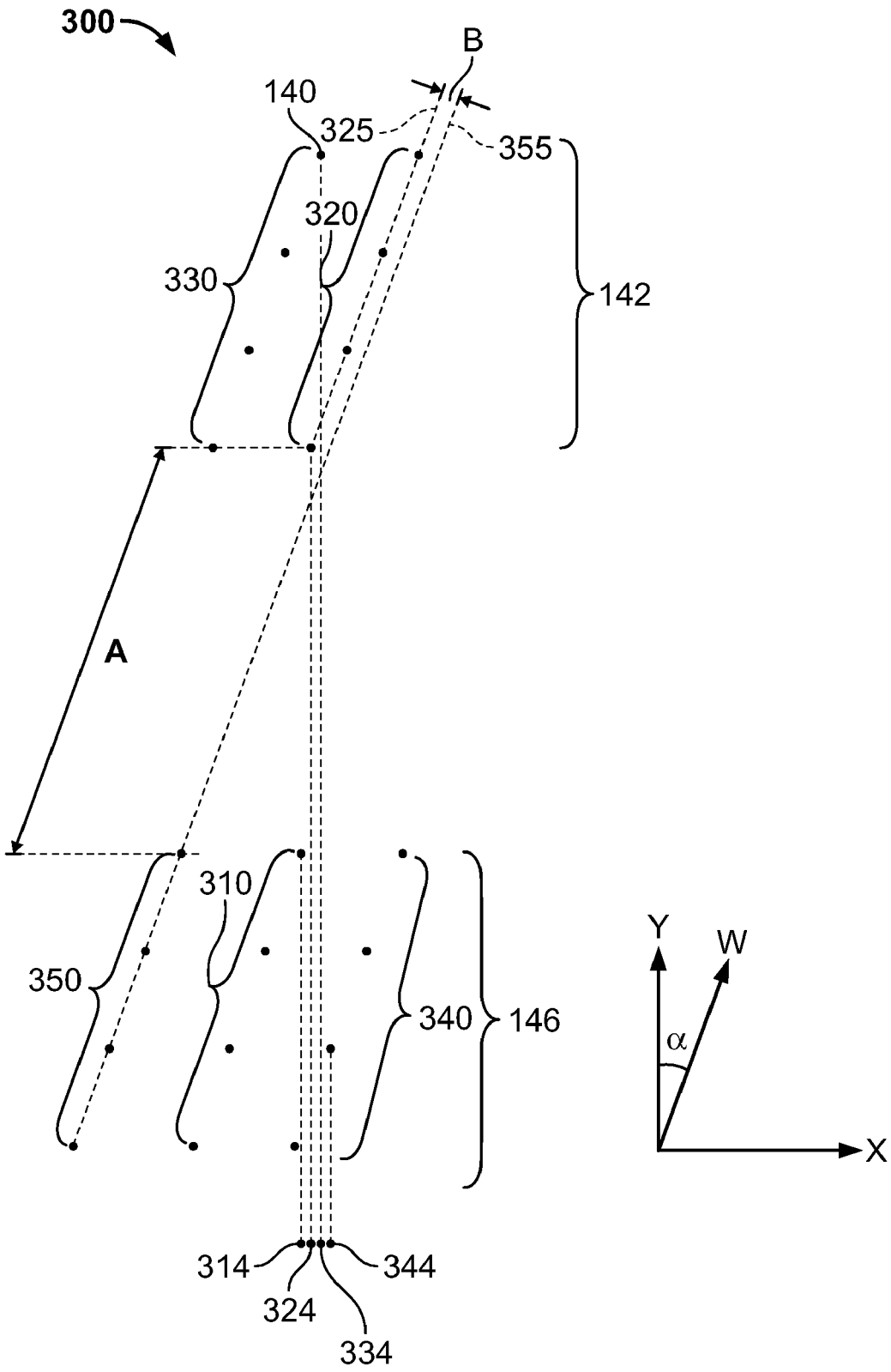
FIG. 3 is a plan-view schematic representation of a nozzle layout.

FIG. 3 is a plan-view schematic representation of a nozzle layout 300 on a portion of the nozzle face 130 in an implementation of the substrate 120. For illustrative purposes, only a small number of nozzles 140 are shown. The nozzle layout 300 can include nozzle groups 310, 320, 330, 340, and 350. Nozzle groups 320 and 330 can be positioned in the first nozzle region 142. Nozzle groups 310, 340, and 350 can be positioned in the second nozzle region 146. Nozzle groups can be positioned on linear columns and may be referred to as columns of nozzles herein. For example, the nozzles 140 in nozzle group 320 can be positioned on a first column line 325, and the nozzles 140 in nozzle group 350 can be positioned on a second column line 355. Columns of nozzles, such as the first and second column lines 325, 355, can extend in the w direction and can be parallel to one another. The nozzle layout 300 can be configured to deposit adjacent uniformly spaced fluid droplets 314, 324, 334, and 344 on the medium 930 (see FIG. 9) as the medium 930 moves relatively to the nozzle face 130 while proximate thereto. Droplets 314, 324, 334, and 344 in a group of four adjacent droplets can be deposited by individual nozzles 140 that are part of nozzle groups 310, 320, 330, and 340, respectively. In some implementations, each droplet can form a dot, and the droplets can be deposited with a density of 1200 dots per inch (DPI). DPI is a measurement of droplet density in some implementations.

Implementation of the gap region 150 may require shifting of columns of nozzles in a direction other than the w direction in order to deposit fluid droplets in desired positions. In some implementations, the first column line 325 and the second column line 355 can be parallel and separated by an alignment offset B. The first and second column lines 325, 355 can be nearly or approximately collinear, but the alignment offset B therebetween can be implemented to properly align nozzle groups, such as nozzle groups 320 and 350, so that droplets 314, 324, 334, and 344 are deposited on the medium 930 in desired positions. For example, the alignment offset B can be implemented so that droplets 314, 324, 334, and 344 do not overlap one another but instead are evenly spaced apart from one another. However, the offset B may be sufficiently small that an inlet channel 216 or outlet channel 226 can be linear but can nonetheless be fluidically connected to nozzle groups in both the first nozzle region 142 and the second nozzle region 146, such as nozzle groups 320 and 350.

Figure 4:
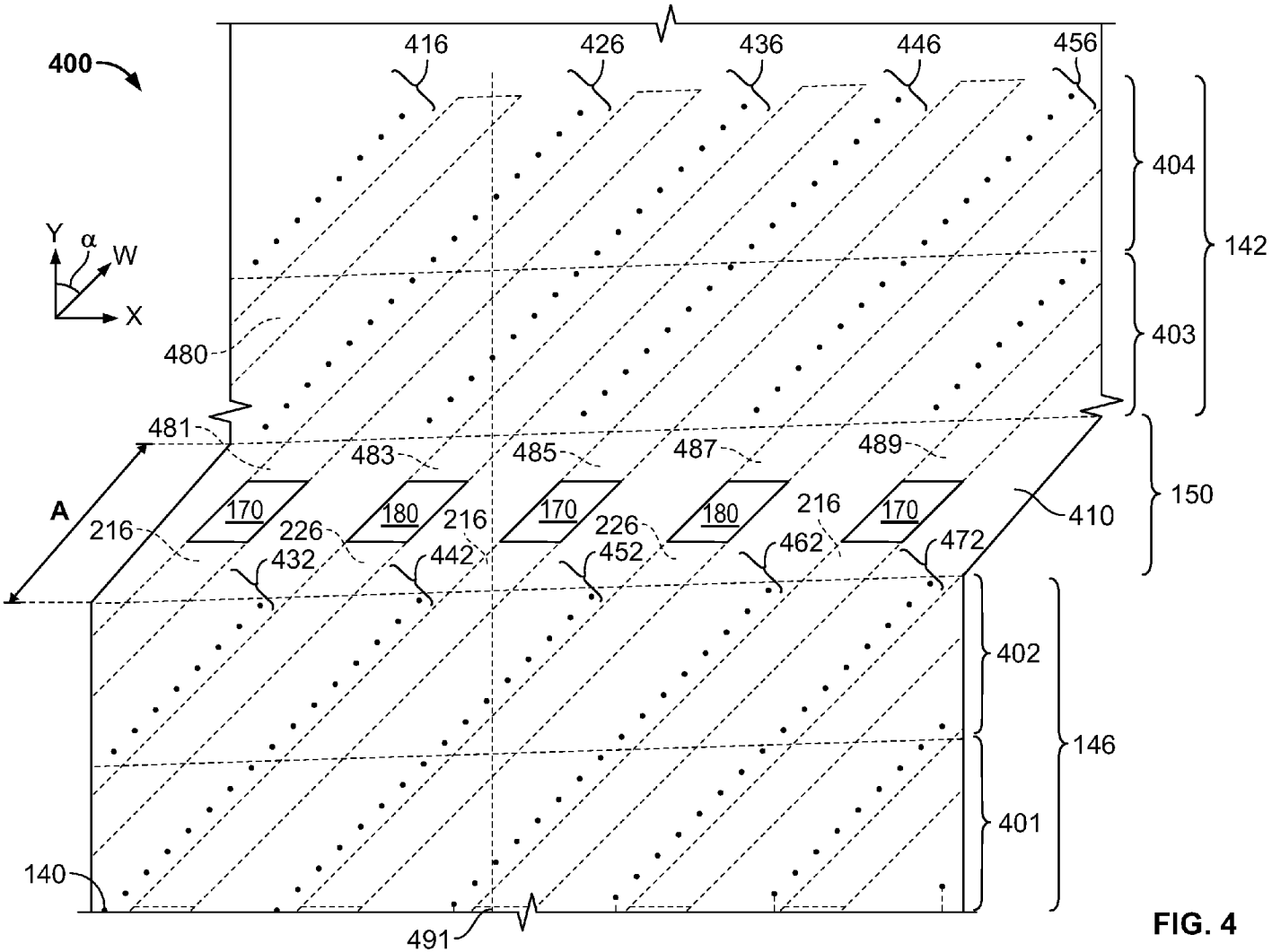
FIG. 4 is a plan-view schematic representation of a nozzle layout.

FIG. 4 is a plan-view schematic representation of a nozzle layout 400 illustrated through a portion of the upper face 410 of an implementation of the substrate 120. The illustration of FIG. 4 is expanded along the x direction such that angle a between the y direction and the w direction appears greater than in, for example, FIG. 1. The nozzles 140 are positioned in a first band 401, a second band 402, a third band 403, and a fourth band 404. The third and fourth bands 403, 404 are positioned in the first nozzle region 142. The first and second bands 401, 402 are positioned in the first second nozzle region 142, and portions of these nozzle groups are in the third band 403 and the fourth band 404. Nozzle groups 432, 442, 452, 462, and 472 are positioned in the second nozzle region 146, and portions of these nozzle groups are in the first band 401 and the second band 402. Nozzle layout implementations and considerations are further discussed in U.S. Application No. 61/055,936, filed May 23, 2008, by Kusakari et al., entitled "Nozzle Layout for Fluid Droplet Ejecting," which is hereby incorporated herein in its entirety.

Figure 5:
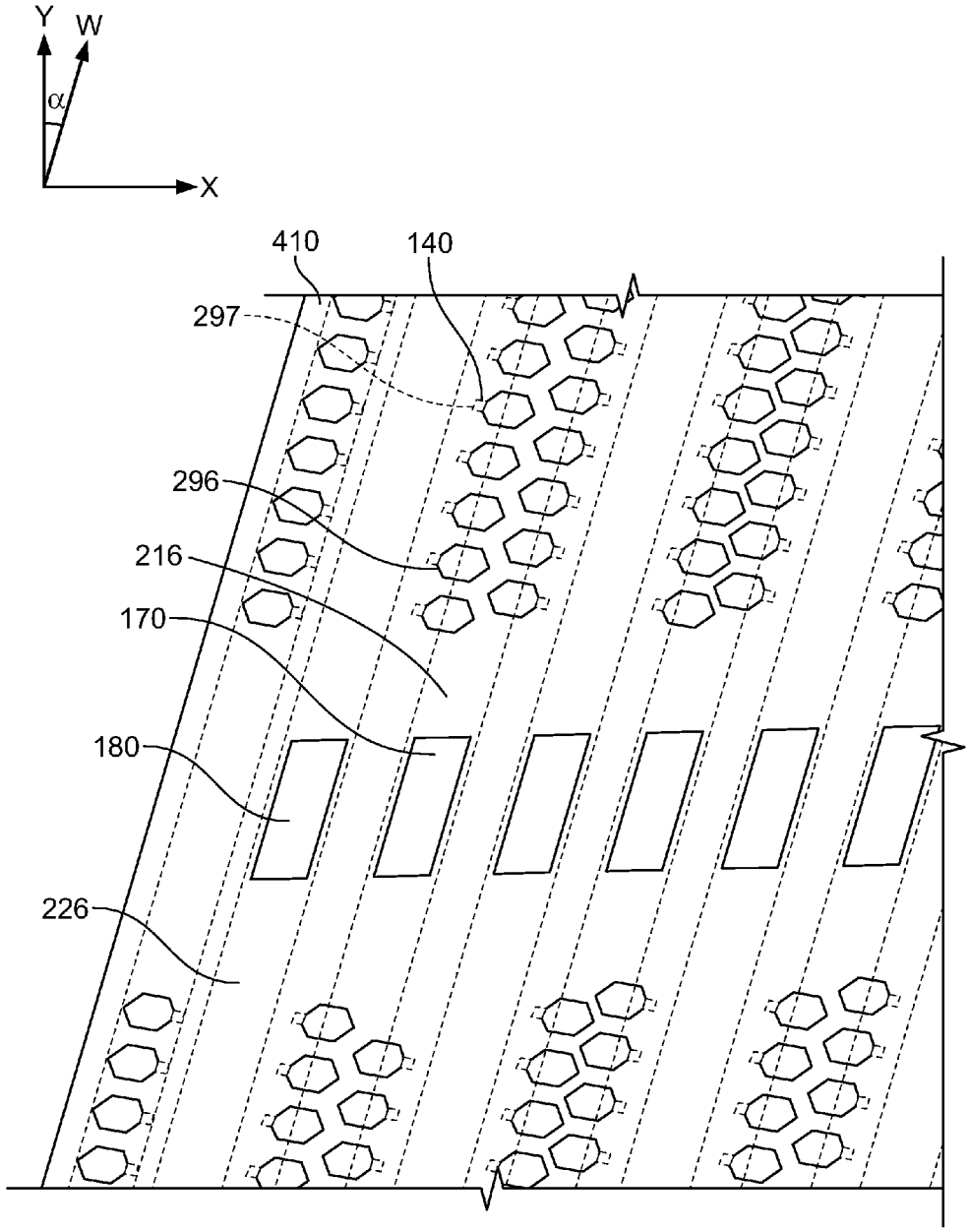
FIG. 5 is a plan-view schematic representation of a portion of a substrate.

FIG. 5 is a plan-view schematic representation of a portion of the upper face 140 of an implementation of the substrate 120. Transducers 296 corresponding to each nozzle 140 can be positioned above fluid pumping chambers 294 that can be formed in the substrate 120 in a portion of the substrate 120 adjacent to each transducer 296. That is, in some implementations, an outline of each transducer 296 can correspond to an outline of each fluid pumping chamber 294. Each fluid pumping chamber 294 can be fluidically connected to a fluid inlet channel 216 by the ascender 292, as discussed above. Each nozzle 140 can be fluidically connected to a corresponding fluid pumping chamber 294 by descenders 297.

Referring to FIGS. 4 and 5, inlet and outlet channels 216, 226 shown in FIG. 4 include inlet channels 481, 485, and 489 and outlet channels 483 and 487. In this implementation of the substrate 120, nozzles 140 depositing adjacent or nearby fluid droplets on the medium 930 (see FIG. 9) can be supplied with fluid from different fluid channels. For example, nozzles 140 in nozzle groups 426 and 436 can be supplied with fluid by inlet channel 481. Nozzles 140 in nozzle group 452 can be supplied with fluid by inlet channel 485. Nozzles 140 in nozzle group 462 can be supplied with fluid by inlet channel 489. Nozzles groups 426, 436, 452, and 462 can overlap along a line 491 in the y direction, and the y direction can be the direction in which the medium 930 translates during fluid droplet ejection. A region of the medium 930 corresponding to a portion of the nozzle layout 400 near the line 491 can thus be deposited with fluid droplets from inlet channels 481, 485, and 489.

In some implementations, this distribution of fluid supply to the medium may reduce strain on the printhead 100, such as by reducing pressure drops in the inlet channels 216 caused by fluid droplet ejection, as compared to implementations of the substrate 120 that do not include a gap region. Without being limited to any particular theory, reducing distances that fluid must travel between the inlet 170 and the nozzles 140 can reduce resistance to fluid flow and thereby reduce pressure drops in the inlet channels 216. Also, it can be desirable that droplets near or adjacent to one another on the medium 930 are deposited by nozzles supplied by different inlet channels 216. Similarly, it can be desirable that nozzles depositing droplets near or adjacent to one another on the medium 930 are fluidically connected to different outlet channels 226. For example, nozzles 140 in nozzle groups 426, 436, 452, and 462 can be fluidically connected to outlet channels 480, 483, and 487. Such an arrangement may similarly reduce pressure drops in the outlet channels 226 caused by fluid droplet ejection as compared to implementations of the substrate 120 that do not include a gap region.

In FIGS. 1, 2A, 3 and 4, the gap distance A is shown as measured in the w direction. Alternatively, the gap distance A can be measured in the y direction. In some implementations, the gap distance A can be expressed as a number of nozzle pitches P in the w direction. For example, in implementations including 16 nozzles per column portion, such as nozzle group 442, the gap distance A can be equal to about 6 to 24 nozzles pitches P, e.g., about 8 nozzle pitches P. It may be desirable to use a gap distance A about equal to a number of nozzle pitches P that is mathematically evenly divisible by the number of nozzles in a nozzle group so as to equal a whole number or a unit fraction. For example, for the nozzle group 442 having 16 nozzles 140, desirable gap distances A might include 2, 4, 8, 16, or 32 times the nozzle pitch P. Use of such a gap distance A may simplify arrangement of the nozzle pattern 400 as well as programming of the controller 970, e.g., selection of timing delays to deposit droplets in a line on the medium 930. However, any gap distances A can be used, such as any gap distance A sufficient or desired for positioning of the inlets 170, the outlets 180, or the ASICs 160.

Figure 6A:
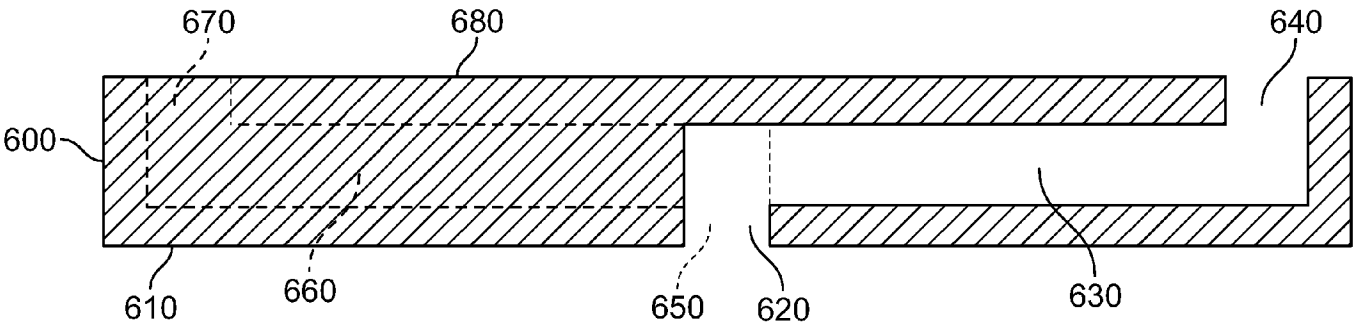
FIG. 6A is a cross-sectional elevation-view schematic representation of an interposer.
Figure 6B:
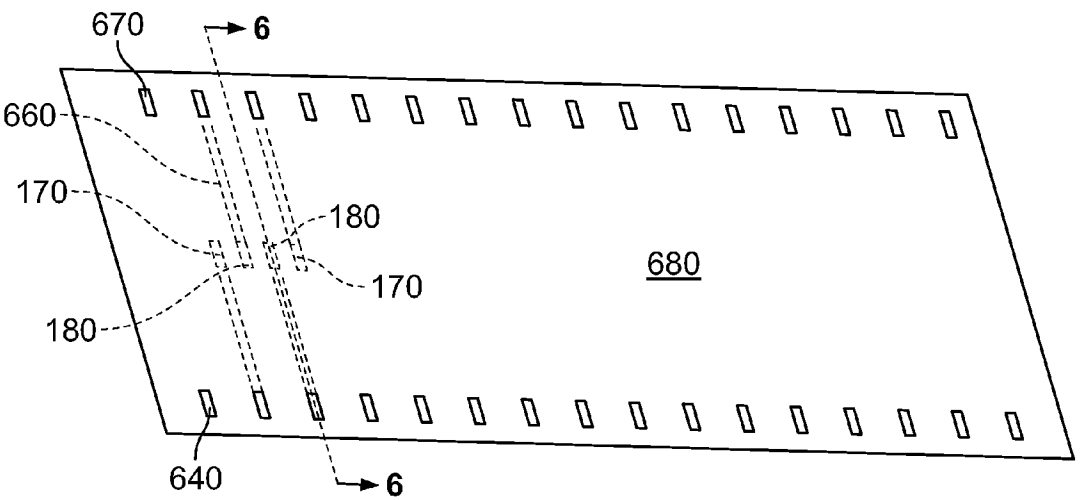
FIG. 6B is a plan-view schematic representation of the interposer of FIG. 6A.

FIG. 6A is a cross-sectional elevation-view schematic representation of an interposer 600 taken along line 6-6 in FIG. 6B and in a direction of the arrows. For illustrative purposes, FIG. 6A is not necessarily drawn to scale. The interposer 600 can have an interface 610 with an inlet port 620 formed therein. An interposer inlet passage 630 can be formed in the interposer 600 and can fluidically connect the inlet port 620 to an interposer inlet 640 formed in an interposer top face 680 that is opposite the interface 610. An outlet port 650 can also be formed in the interface 610. An interposer outlet passage 660 can be formed in the interposer 600 and can fluidically connect the outlet port 650 to an interposer outlet 670 formed in the interposer top face 680. The interposer outlet passage 660 is illustrated in phantom in FIG. 6 because it is offset with respect to the interposer inlet passage 630 (see FIG. 6B).

FIG. 6B is a plan-view schematic representation of the interposer 600 of FIG. 6A. For illustrative purposes, FIG. 6B is not necessarily drawn to scale. Interposer inlets 640 and interposer outlets 670 are shown formed near edges of the interposer 600. For illustrative purposes, only two sets of inlets 170, outlets 180, interposer inlet passages 630, and interposer outlet passages 660 are shown. In some implementations of the printhead 100, it can be desirable to carry fluid from a fluid space (not shown) near an edge of the printhead 100 to the inlet 170 of the substrate 120. This can be desirable because directly carrying fluid to and from the inlets 170 and outlets 180 may be difficult in implementations where the inlets 170 and outlets 180 are closely arranged in an alternating pattern in the gap region 150. The interposer 600 can thus facilitate supplying fluid to the inlets 170 and carrying fluid out of the outlets 180.

FIG. 7 is a plan-view schematic representation of an alternative implementation of a substrate 120' of a printhead 100'. ASICs 160 are attached to a portion of the substrate 120' that is opposite the gap region 150, and the ASICs 160 are accordingly illustrated in phantom in FIG. 7. In this implementation, inlets 170 and outlets 180 can be positioned near edges of the substrate 120'. Such an implementation may permit use of relatively large traces 850 where, for example, there are no inlets 170 or outlets 180 between the ASICs 160 and the transducers 296 corresponding to the nozzles 140. In some implementations, an electrical interposer (not shown) can be attached to the ASICs 160 to facilitate electrical connection of a flex connector (not shown) to the ASICs 160.

In some implementations, forming the inlets 170 and outlets 180 in a region of the substrate 120 other than between the ASICs 160 and the transducers 296, such as near a middle of the substrate 120, may facilitate use of relatively wider and more widely spaced traces 850. For example, the trace width can be greater than 6 microns, such as about 7 to 12 microns, and the spacing can be greater than 5.5 microns, such as about 7 to 35 microns.

Figure 10:
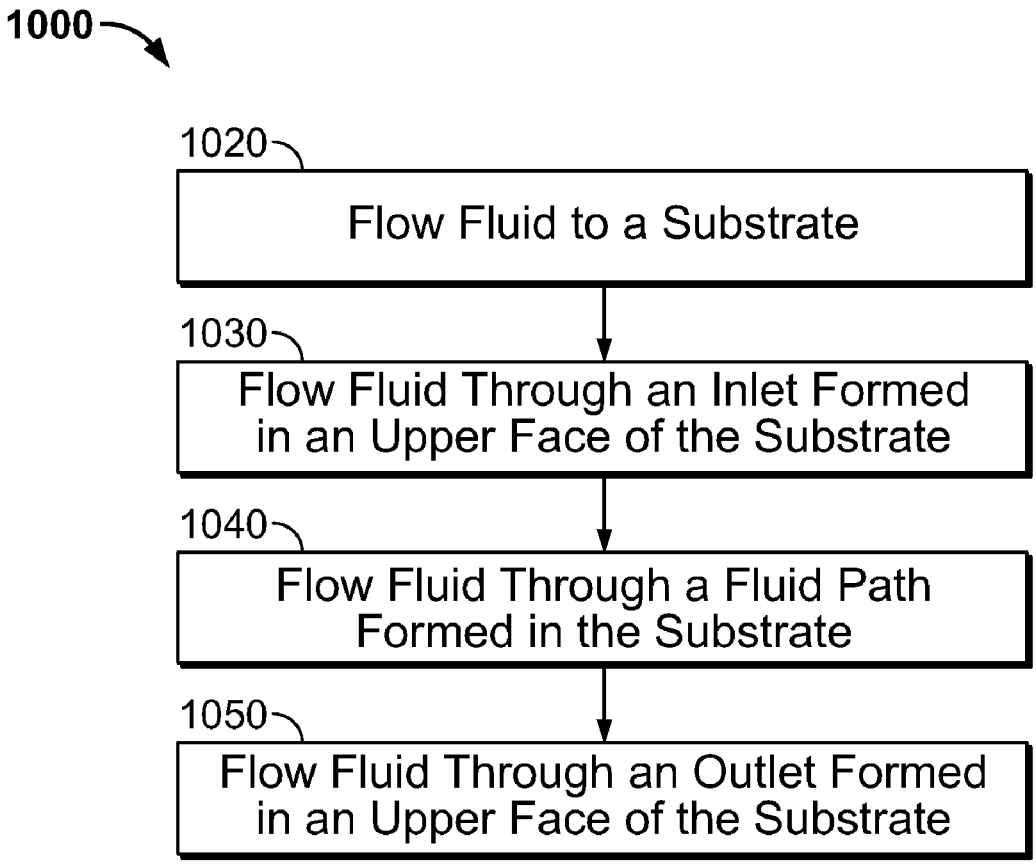
FIG. 10 is a flow diagram of a method for flowing fluid.

FIG. 10 is a flow diagram of an implementation of a method 1000 for flowing fluid through an implementation of the substrate 100. Fluid can flow from a fluid supply (not shown) through a fluid supply hose 950 to the substrate 120 (step 1020). The fluid supply can be, for example, a fluid tank positioned such that gravity facilitates a flow of fluid to the substrate 120. Fluid can be flowed through an inlet formed in the upper face 410 of the substrate 120 (step 1030). Fluid can then be flowed through a fluid path formed in the substrate (step 1040). For example, fluid can flow through a fluid inlet channel 216, through an ascender 292, through a corresponding fluid pumping chamber 294, and into a corresponding descender 297. From the descender 297, fluid can flow either out of the substrate 120 through a corresponding nozzle 140 or can flow to a corresponding recirculation passage 298 to an outlet channel 226. From the outlet channel 226, fluid can flow out of the substrate 120 through an outlet 180 formed in the upper face 410 of the substrate (step 1050). From the outlet 180, fluid can flow through a fluid return hose 960 and can, for example, return to the fluid supply tank or be discarded.

In implementations including the gap region 150, nozzles 140 near ends of the print frame 910 along the x direction may be unused or may be unable to achieve a full droplet density (e.g., DPI) that the print frame assembly 900 as a whole is configured to achieve. However, this can be an acceptable or desirable compromise in implementing systems, apparatus, and method with the gap region 150.

The above-described implementations can provide none, some, or all of the following advantages. Positioning the inlets and outlets near the middle of the substrate can reduce fluid travel distances between the inlets and outlets and the nozzles, which may advantageously reduce pressure drops and pressure fluctuations along inlet and outlet channels. Pressure interference between nozzles may also be reduced. Positioning the inlets and outlets near the middle of the substrate can also increase surface area of the substrate that is available for traces and for bond areas. Reliability may be improved because, for example, relatively large bond areas around the inlets and outlets may be relatively less likely, as compared to a relatively small bond area, to leak fluid that might interfere with proper functioning of the traces. Also, bonding to the substrate, such as bonding the interposer to substrate can be permissibly less accurate without interfering with the traces. That is, because the traces can be separated from the inlets and outlets by a greater distance than if the inlets and outlets are positioned between the ASICs and the transducers, the interposer can be bonded to the substrate relatively less accurately without interfering with the traces. Reliability may also be improved because increased trace width may be achieved, which can reduced a risk of open circuits or other trace defects. Increased spacing between traces may also be achieved, which can reduce risks of short circuits and cross-talk.

The use of terminology such as "front," "back," "top," "bottom," "above," and "below" throughout the specification and claims is to distinguish relative positioning between and orientation of various components of the system. The use of such terminology does not imply a particular orientation of the printing module in operation.

A number of embodiments of the invention have been described. Nevertheless, it will be understood that various modifications may be made without departing from the spirit and scope of the invention. For example, the gap region can be positioned other than near a middle of the substrate. The first nozzle region and the second nozzle region can be different sizes or can have different dimensions or arrangements of nozzles. Also, the nozzle face can include multiple gap regions and more than two nozzle regions. Droplet density can be 300 dpi, 600 dpi, or some other dpi. Inlets and outlets can be other than adjacent. For example, inlets and outlets can be grouped together in regions and these regions can be separated from one another. Accordingly, other embodiments are within the scope of the following claims.

What is claimed is:

1. An apparatus for ejecting droplets of a fluid, comprising:
a substrate having a nozzle face and an upper face on a side of the substrate farther from the nozzle face;
a first plurality of nozzles formed in a first region of the nozzle face of the substrate;
a second plurality of nozzles formed in a second region of the nozzle face, the second region being separated from the first region by a third region of the nozzle face;
an inlet for flowing fluid into the substrate and an outlet for flowing fluid out of the substrate both formed in a portion of the upper face of the substrate opposite the third region of the nozzle face, the third region being located between the first region and the second region; and
a plurality of fluid paths formed in the substrate and fluidically connecting the first plurality of nozzles and the second plurality of nozzles with the inlet and outlet.

2. The apparatus of claim 1, further comprising:
a plurality of inlets and outlets formed adjacent to one another in an alternating pattern.

3. The apparatus of claim 1, further comprising:
an application-specific integrated circuit attached to the upper face near an edge of the substrate.

4. The apparatus of claim 1, further comprising:
an interposer attached to the upper face of the substrate, the interposer comprising:
an inlet passage formed in an interposer face of the interposer and configured to align with the inlet of the substrate; and
an outlet passage formed in the interposer face and configured to align with the outlet of the substrate.

5. The apparatus of claim 1, wherein the substrate has a length along a length direction and a width along a width direction, the width being shorter than the length, and wherein the inlet and the outlet are positioned, along the width direction, between the first region and the second region.

6. An apparatus for ejecting droplets of a fluid, comprising:
a substrate;
a first plurality of nozzles formed in a first region of a nozzle face of the substrate; a second plurality of nozzles formed in a second region of the nozzle face, the second region being separated from the first region;
an inlet and an outlet both formed in an upper face of the substrate opposite a third region of the nozzle face, the third region being located between the first region and the second region;
a plurality of fluid paths formed in the substrate and fluidically connecting the first plurality of nozzles and the second plurality of nozzles with the inlet and outlet;

a support configured to position a medium proximate the nozzle face and move the medium in a medium travel direction relative to the nozzle face;

a first group of nozzles formed in the nozzle face, positioned on a first column, and configured to eject a first set of fluid droplets onto the medium; and a second group of nozzles formed in the nozzle face, positioned on a second column that is different than the first column and separated from the first column, and configured to deposit a second set of fluid droplets onto the medium as the medium moves in the medium travel direction, the second set of fluid droplets being adjacent the first set of fluid droplets.

7. The apparatus of claim 6, wherein the first column and the second column are parallel to one another.

8. The apparatus of claim 6, further comprising:

a first fluid inlet channel positioned substantially parallel to the first column and fluidically connected to the first group of nozzles; and a second fluid inlet channel, different than the first fluid inlet channel, positioned substantially parallel to the second column and fluidically connected to the second group of nozzles.

9. The apparatus of claim 8, further comprising:

a third group of nozzles formed in the nozzle face and positioned on a third column that is different than the first and second columns but is substantially parallel with a column direction of the first column, wherein the first group of nozzles is in the first region, the second group nozzles is in the second region, and the third group of nozzles is in the second region, wherein the third group of nozzles is fluidically connected to the first fluid inlet channel, and wherein the first fluid inlet channel is substantially linear.

10. A method for ejecting fluid droplets, comprising:

flowing a flow of fluid to a substrate, the substrate including a nozzle face, an upper face on a side of the substrate farther from the nozzle face, a first plurality of nozzles formed in a first region of the nozzle face of the substrate and a second plurality of nozzles formed in a second region of the nozzle face, the second region being separated from the first region by a third region;

flowing the flow of fluid into the substrate through an inlet formed in a portion of the upper face of the substrate opposite the third region of the nozzle face, the third region being located between the first region and the second region and the inlet being fluidically connected to a fluid path formed in the substrate;

flowing the flow of fluid through the fluid path, the fluid path being fluidically connected to a nozzle of the first plurality of nozzles and a nozzle of the second plurality of nozzles; and flowing the flow of fluid from the fluid path out of the substrate through an outlet formed in the upper face opposite the third region, the outlet being fluidically connected to the fluid path.

11. The method of claim 10, further comprising:

flowing the flow of fluid from the outlet to the inlet.

12. The method of claim 10, wherein the substrate includes a plurality of inlets and outlets formed adjacent to one another in an alternating pattern.

13. The method of claim 10, wherein an application-specific integrated circuit is attached to the upper face near an edge of the substrate.

14. The method of claim 10, wherein an interposer having an interposer face is attached to the upper face of the substrate, and wherein the interposer includes an inlet passage formed in the interposer face and configured to align with the inlet of the substrate, and wherein the interposer includes an outlet passage formed in the interposer face and configured to align with the outlet of the substrate.

15. The method of claim 10, wherein the substrate has a length along a length direction and a width along a width direction, the width being shorter than the length, and wherein the inlet and the outlet are positioned, along the width direction, between the first region and the second region.

16. A method for ejecting fluid droplets, comprising:

flowing a flow of fluid to a substrate, the substrate including a first plurality of nozzles formed in a first region of a nozzle face of the substrate and a second plurality of nozzles formed in a second region of the nozzle face, the second region being separated from the first region;

flowing the flow of fluid through an inlet formed in an upper face of a substrate opposite a third region of the nozzle face, the third region being located between the first region and the second region and the inlet being fluidically connected to a fluid path formed in the substrate;

flowing the flow of fluid through the fluid path, the fluid path being fluidically connected to a nozzle of the first plurality of nozzles and a nozzle of the second plurality of nozzles; and flowing the flow of fluid from the fluid path through an outlet formed in the upper face opposite the third region, the outlet being fluidically connected to the fluid path;

wherein a support is configured to position a medium proximate the nozzle face and move the medium in a medium travel direction relative to the nozzle face, wherein a first group of nozzles is formed in the nozzle face, positioned on a first column, and configured to eject a first set of fluid droplets onto the medium, and wherein a second group of nozzles formed in the nozzle face, positioned on a second column that is different than the first column and separated from the first column, and configured to deposit a second set of fluid droplets onto the medium as the medium moves in the medium travel direction, the second set of fluid droplets being adjacent the first set of fluid droplets.

17. The method of claim 16, wherein a first fluid inlet channel is positioned substantially parallel to the first column and is fluidically connected to the first group of nozzles, and wherein a second fluid inlet channel, different than the first fluid inlet channel, is positioned substantially parallel to the second column and is fluidically connected to the second group of nozzles.

18. The method of claim 17, wherein a third group of nozzles is formed in the nozzle face and positioned on a third column that is different than the first and second columns but is approximately aligned with a column direction of the first column, wherein the first group of nozzles is in the first region, the second group nozzles is in the second region, and the third group of nozzles is in the second region, wherein the third group of nozzles is fluidically connected to the first fluid inlet channel, and wherein the first fluid inlet channel is substantially linear.

19. An apparatus for ejecting droplets of a fluid, comprising:

a substrate having a nozzle face and an upper face on a side of the substrate farther from the nozzle face;

a first plurality of nozzles formed in a first region of the nozzle face of the substrate;

a second plurality of nozzles formed in a second region of the nozzle face, the second region being separated from the first region by a third region of the nozzle face; and an application-specific integrated circuit attached to an upper face of the substrate opposite the third region of the nozzle face, the third region being located between the first region and the second region.

20. The apparatus of claim 19, wherein the substrate includes a first plurality of pumping chambers and a second plurality of pumping chambers, the substrate includes an inlet and an outlet on the upper face, and wherein each fluid path of the plurality of fluid paths fluidically connects, in order, the inlet to a pumping chamber of the first plurality of pumping chambers or the second plurality of pumping chambers, the pumping chamber to a nozzle from the first plurality of nozzles or the second plurality of nozzles, and the nozzle to the outlet.

21. The apparatus of claim 20, further comprising a first plurality of actuators formed on a first portion of the upper face of the substrate opposite the first region and a second plurality of actuators positioned on the upper face of the substrate opposite the second region of the nozzle face, such that the inlet and the outlet are positioned on the upper face between the first region and the second region.

22. The apparatus of claim 21, wherein each actuator of the first plurality of actuators is positioned over a pumping chamber from the first plurality of pumping chambers and each actuator of the second plurality of actuators is positioned over a pumping chamber from the second plurality of pumping chambers.

* * * * *

UNITED STATES PATENT AND TRADEMARK OFFICE

CERTIFICATE OF CORRECTION

PATENT NO. : 8,157,352 B2
APPLICATION NO. : 12/393985
DATED : April 17, 2012
INVENTOR(S) : Kevin Von Essen It is certified that error appears in the above-identified patent and that said Letters Patent is hereby corrected as shown below:

In Claim 9, column 11, line 30, delete "group nozzles" and insert -- group of nozzles --, therefor.

In Claim 18, column 12, line 57, delete "group nozzles" and insert -- group of nozzles --, therefor.

Signed and Sealed this
Thirty-first Day of July, 2012

David J. Kappos

David J. Kappos
*Director of the United States Patent and Trademark Office*